US012221731B2

(12) United States Patent
Callens et al.

(10) Patent No.: US 12,221,731 B2
(45) Date of Patent: Feb. 11, 2025

(54) PRESSER FOOT MODULE FOR A TUFTING MACHINE

(71) Applicant: Vandewiele NV, Kortrijk (BE)

(72) Inventors: Frank Callens, Oostrozebeke (BE); Kristof Oosterlynck, Ooigem (BE); Vincent Lampaert, Vichte (BE); Frank Shanley, Lancashire (GB)

(73) Assignee: Vandewiele NV, Kortrijk (BE)

( * ) Notice: Subject to any disclaimer, the term of this patent is extended or adjusted under 35 U.S.C. 154(b) by 205 days.

(21) Appl. No.: 17/620,435

(22) PCT Filed: Jun. 18, 2020

(86) PCT No.: PCT/EP2020/067037
§ 371 (c)(1),
(2) Date: Dec. 17, 2021

(87) PCT Pub. No.: WO2020/254536
PCT Pub. Date: Dec. 24, 2020

(65) Prior Publication Data

US 2022/0325457 A1 Oct. 13, 2022

(30) Foreign Application Priority Data

Jun. 20, 2019 (GB) ..... 1908846

(51) Int. Cl.
*D05C 15/14* (2006.01)
*D05B 29/00* (2006.01)
(Continued)

(52) U.S. Cl.
CPC ..... *D05C 15/14* (2013.01); *D05B 29/00* (2013.01); *D05C 15/10* (2013.01); *D05C 15/22* (2013.01)

(58) Field of Classification Search
CPC ..... D05C 15/00; D05C 15/08; D05C 15/14; D05C 15/22; D05C 15/10; D05C 15/04; D05B 29/00; D05B 29/06
See application file for complete search history.

(56) References Cited

U.S. PATENT DOCUMENTS 1,342,775 A * 6/1920 Strobeck ..... D05B 29/00 112/235
2,022,858 A * 12/1935 Hathaway ..... D05C 15/00 28/216

(Continued)

FOREIGN PATENT DOCUMENTS

GB 884517 A * 12/1961 ..... D05C 15/00
GB 1063180 3/1967

(Continued)

OTHER PUBLICATIONS

International Search Report issued by the European Patent Office for corresponding application No. PCT/EP2020/067037 on Oct. 1, 2020; 3 pages.

(Continued)

*Primary Examiner* — Patrick J. Lynch
(74) *Attorney, Agent, or Firm* — Patterson + Sheridan, LLP

(57) ABSTRACT

A presser foot module (50) for a tufting machine. The module has a module body (13) for attachment to a tufting machine and the plurality of fingers (12) extending from the body in a first direction which, in use, is opposite to the direction in which the backing medium (1) is fed through the tufting machine. The module body (13) has a downwardly depending lip (53) defining a presser surface (53A) extending across an end of the body which is adjacent to the interface with the fingers (12). Each finger (12) has an unsupported end opposite to the module body (13) so as to (Continued)

provide access to an open gap between adjacent fingers in a direction opposite to the first direction.

17 Claims, 3 Drawing Sheets

(51) Int. Cl.
*D05C 15/10* (2006.01)
*D05C 15/22* (2006.01)

(56) References Cited

U.S. PATENT DOCUMENTS 2,598,579 A * 5/1952 McCutchen ..... D03D 39/24 26/11
3,177,833 A * 4/1965 Passons ..... D05C 15/12 112/80.43
3,386,403 A * 6/1968 Short ..... D05C 15/26 112/80.71
3,420,197 A * 1/1969 Jacobsen ..... D05B 29/00 112/235
4,303,024 A 12/1981 Bardsley
4,913,073 A * 4/1990 Komori ..... D05B 29/06 112/235
5,295,450 A * 3/1994 Neely ..... D05C 15/22 112/80.6
5,560,307 A * 10/1996 Padgett, III ..... D05C 17/026 112/80.15
5,974,991 A * 11/1999 Bardsley ..... D05C 15/20 112/80.45

FOREIGN PATENT DOCUMENTS

| | | |
|---|---|---|
| GB | 1120038 | 7/1968 |
| GB | 2077308 | 12/1981 |
| GB | 2117803 | 10/1983 |
| GB | 2123453 | 2/1984 |
| GB | 2266537 | 11/1993 |
| JP | H11124764 | 5/1999 |
| WO | WO9967458 | 12/1999 |

OTHER PUBLICATIONS

Search Report issued by the Great Britain Patent Office for corresponding application No. GB1908846.7 on Nov. 25, 2019; 4 pages.
Search Report issued by the Great Britain Patent Office for corresponding application No. GB1908846.7 on May 29, 2020; 3 pages.

* cited by examiner

PRESSER FOOT MODULE FOR A TUFTING MACHINE

The present invention relates to a presser foot module for a tufting machine.

A presser foot module is a gauge part of a tufting machine. The modules are attached to a presser foot bar. This is a bar which is mounted immediately above the backing medium which is fed through a tufting machine. The presser foot module is distinct from other tufting machine gauge parts such as the hooks, needles and reeds.

Broadly, a conventional presser foot module comprises two main parts, namely a module body and a plurality of fingers extending from the body. The module body is provided with an opening via which the module is mounted to the presser foot bar. The underside of the body acts as a presser surface pressing yarns against the rear face of the backing medium following after the yarns have been tufted into the backing medium. In this region, there will be a number of yarns which have not been tufted into the backing medium and the presser foot exerts a pressure on these to ensure that they are kept roughly in the right position such that any interference with adjacent yarns is minimised without the yarns being lost out of the needle eye.

From the module body, a plurality of fingers protrude. These have a flat plate like structure and protrude from the module body in a direction which, in use, is opposite to the direction in which the backing medium is fed through the tufting machine. The fingers have a relatively longitudinal dimension and therefore, in order to prevent them from being deflected and distorted in use as they move sideways with the needle bar, a bar extends across the distal end of the fingers to enhance rigidity. This creates a number of gaps between the module body, two adjacent fingers and the bar at the distal end through which, in use, a needle of a tufting machine reciprocates in order to form a tuft in the carpet. The fingers provide barriers in order to separate the yarn from the yarn of an adjacent needle so as to minimise cross stitching.

In use, the needles are reciprocated in and out of the gap between an adjacent pair of fingers. This causes a problem in that yarn can become trapped between the fingers and the needles. This is less of a problem in a cut pile yarn where the tensions are higher. However, in a loop pile carpet, the loops are more sensitive to trapping between the fingers and the needles because the loops are released from the hooks each time a loop is formed rather than remaining wrapped around the looper for a cut pile.

This can also be a problem for an LCL machine (which forms a combination of loop and cut piles) where the same problems arise for the loop piles. The Applicant has tried many different approaches to try to resolve the problem of snagging of yarns on the fingers. For example, we have tried improving the pitch accuracy of the needles and needle holders, using thinner needles, reducing the needle rack, changing the reed finger profile, changing the hook profile and changing the yarn delivery profile.

There is also a problem that, in order to maintain the yarns under the presser foot, a reasonably high pressure is required. However, this provides increased frictional forces on the yarn which can damage the yarn.

The present invention aims at improving the design of the presser foot to address these problems.

According to a first aspect of the present invention there is provided a presser foot and a tufting machine. The lip provides a presser surface which is significantly narrower than the presser surface of the prior art which has no such lip. As result of this, the presser foot allows a higher pressure to be applied to the yarn across a narrower and more controlled area. This higher pressure provides better holding of the yarn in that area. However, despite this high pressure, the total frictional load applied to the yarn can be significantly lower as the yarn is in contact with the presser foot for a much shorter proportion of its travel. This reduces the possibility of damaging the yarn. Thus, the invention provides improved yarn control and reduced damage.

The lip is relatively narrow. Preferably, the dimension of the downwardly depending lip in the first direction is less than 1.5 times the pitch of the fingers and more preferably, is less than the pitch of the fingers. The pitch of the fingers represents the separation between adjacent fingers.

On the other hand, if the lip is too narrow, this can require too high a pressure to be concentrated over a relatively narrow area. Therefore, preferably, the dimension of the downwardly depending lip in the first direction is greater than 0.5 times the pitch of the fingers.

Preferably the lower edge of each finger has a groove. This helps to keep the yarn in place in a controlled position which is away from any stitch location of a subsequent stitch In a presser foot module, the fingers typically do not extend below the presser surface, unlike in a hook module where the hooks extend beyond the surface of the body which is opposite to the side which is attached to the tufting machine. In a presser foot module, at least part of the lower edge of each finger is typically greater than 0.5 mm and preferably at least 1 mm above the presser surface. This is different from the bed plate where the tops of the reeds are as close as possible to the top of the body as these are required to support the backing medium. In a presser foot module, each finger is typically formed as a single planar component in a plane transverse to the presser surface. This is fundamentally different from the scissor like mechanism of JPH11124764 in which two comb like structures with sharp edges slide relatively to one another to shear fluff.

The fingers may have a bar running across the distal end of the fingers to support them at this end. However, preferably, each finger has a first end mounted in the module body and a second end opposite to the first end which is unsupported so as to provide access to an open gap between adjacent fingers in a direction opposite to the first direction. Such a module provides an advantage over a conventional module that access into the gap between the adjacent teeth is in a direction opposite to the first direction thereby allowing much easier rethreading of a the tufting machine as it is no longer necessary to feed each loose end of yarn downwardly through a gap between adjacent fingers. Further, the present invention allows for enhanced inspection of the threading up of a tufting machine as the bar in the prior art obstructs the view into the tufting region of the machine.

This provides a second aspect of the present invention which is a presser foot module and a tufting machine The module of the prior art needs to the fingers to be relatively long in order that the bar does not obstruct the reciprocation of the needles. However, with the present invention, the fingers can be significantly shorter. Preferably, the maximum length of the finger to the pitch of the fingers is less than 4, preferably less than 3.5 and most preferably less than 3. The shorter fingers are less prone to deflection than the fingers of the prior art. The support provided by the bar is no longer required for these smaller fingers thereby leading to a synergy between the absence of the bar and the shorter fingers.

The present invention also extends to a presser foot bar to which a plurality of modules according to aspects of the invention set out above are attached. The invention also extends to a tufting machine comprising at least one presser foot module as set out above.

An example of a presser foot module and a tufting machine in accordance with the present invention while now be described with reference to the accompanying drawings in which.

Figure 1:
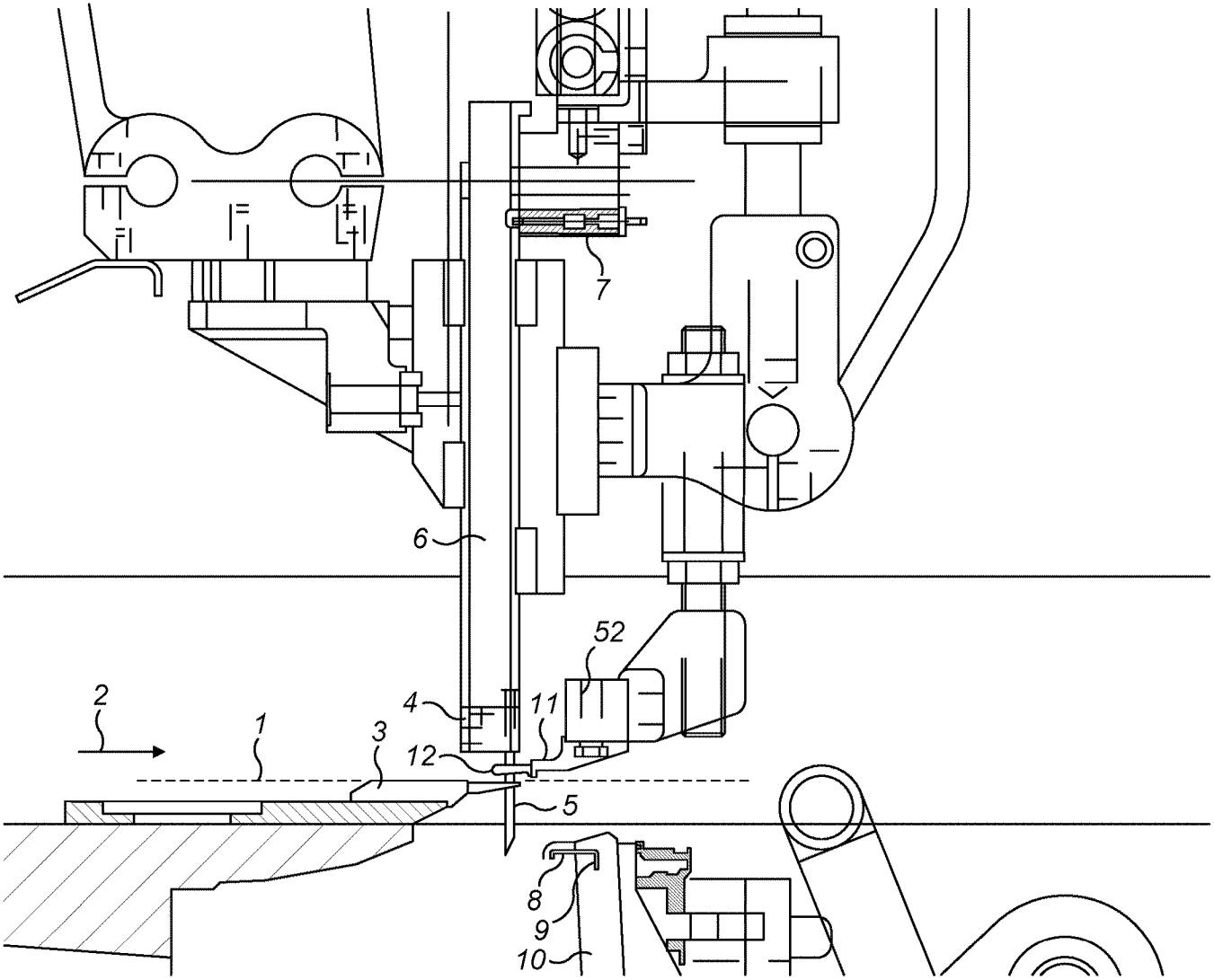
FIG. 1 is a side view of a tufting machine of the present invention.

The tufting machine shown in FIG. 1 is, in almost every respect, a known individual needle control (ICN) machine. As this is largely conventional, the main components will be described briefly here.

The backing medium 1 (depicted schematically as a dashed line in FIG. 1) is fed through the tufting machine in a feed direction depicted by arrow 2 and is supported in the tufting position by a bed plate 3. A needle bar 4 supports a line of needles 5 (the line extending in the direction perpendicular to the plane of FIG. 1). Each needle 5 is supported on a needle support 6. Each needle support 6 has an associated latch 7 such that, if the needle 5 is required to be reciprocated in a particular stroke, the needle 5 can be selectively latched to the needle bar 4 so that it will penetrate the backing medium 1 to form a loop of yarn. This is well-known in the art as an individual needle control (ICN) machine.

Beneath the backing medium 1 is a looper 8 associated with each needle 5. The loopers 8 will rock forwards to pick up a loop of yarn formed by the needle 5. In this example, the loopers are preferably level cut loopers (LCL), these have a latching mechanism which is configured either to ensure that the loop of yarn slips off of the looper 8 or alternatively to ensure that it is retained on the looper 8 such that it slides back to a throat 9 of the looper and is cut by a respective knife 10 in order to form a cut pile tuft. This mechanism is therefore capable of selectively forming loop or cut pile tufts. Further details of a level cut looper are disclosed, for example, in GB 2367305 or GB 2354263.

In order to support the backing medium 1 as the needles 5 are pulled through it in the upwards direction in FIG. 1, a presser foot 11 is provided. This is mounted so as to shift laterally to following the movement of the needle bar 4. The presser foot comprises a plurality of fingers 12 and a mounting body 13.

Although the above described machine is an ICN machine, the presser module can also be used on a conventional tufting machine.

Figure 2B:
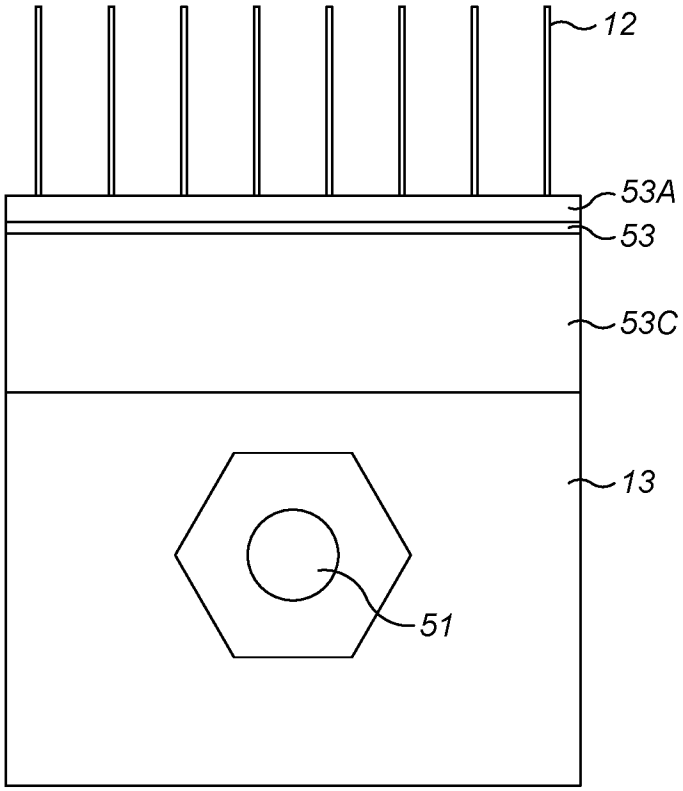
FIG. 2B is a similar view showing a presser foot module according to the present invention.
Figure 3:
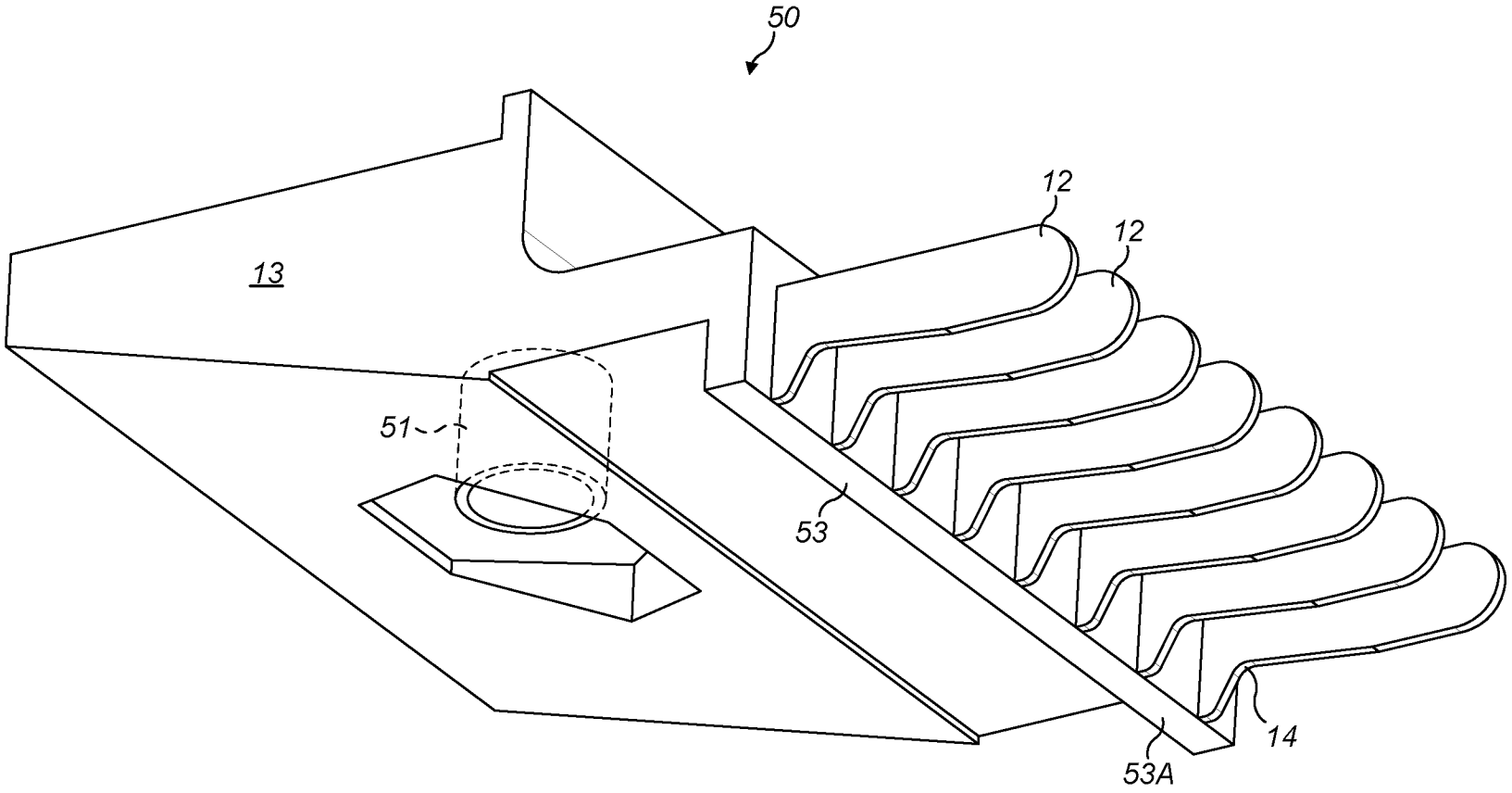
FIG. 3 is a perspective view of a presser foot module according to the invention.

The presser foot module is shown in greater detail in FIGS. 2B and 3. These show one module 50 of the presser foot. As described above, this has a mounting body 13 from which a plurality of fingers 12 project in a direction opposite to the direction 2 in which the backing medium 1 is fed through the tufting machine. The body 13 is provided with a mounting hole 51 by which the presser foot module 50 is mounted to a presser foot bar 52 (FIG. 1) which is mounted to slide laterally together with the needle bar, but does not reciprocate with the needle bar in the direction of reciprocation of the needles. Instead, it remains in the position shown in FIG. 1 immediately above the backing medium 1.

The module 50 has three unconventional features.

Figure 2A:
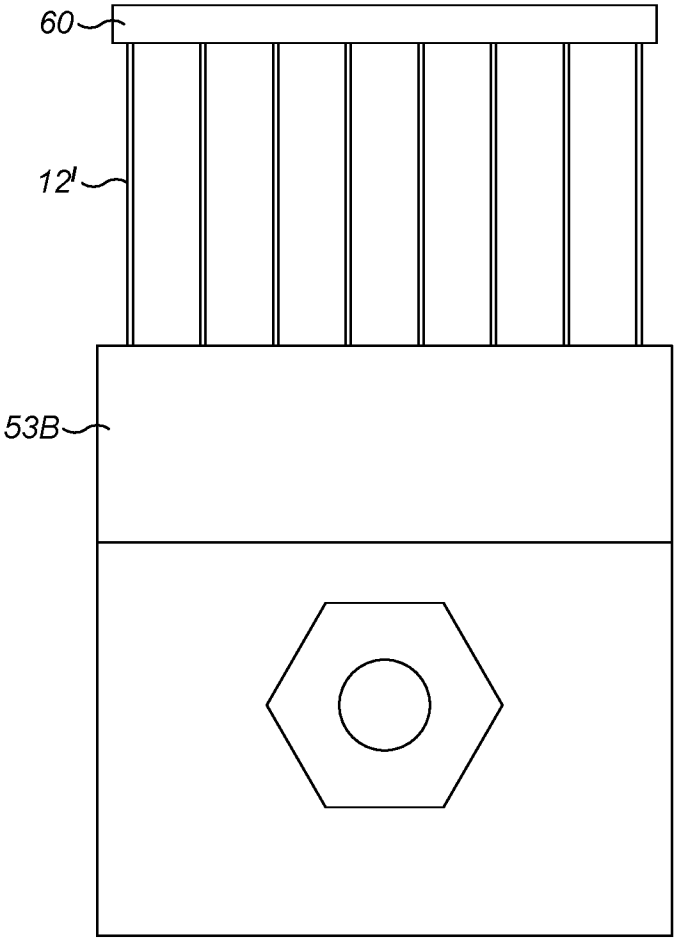
FIG. 2A is a view from below showing a conventional presser foot module.

Firstly, in the conventional presser foot module 50' shown FIG. 2A, a bar 60 extends across the distal end of the FIG. 12' in order to provide enhanced rigidity. In FIG. 2B, no such bar is present such that there is an open gap at the distal of the fingers 12. This improves the rethreading of the tufting machine as, when passing a yarn through the presser foot, this can be done by moving the yarn laterally between two fingers 12, rather than having two thread a cut end from top to bottom as previously. The replacement of a module is also easier.

The second modification is the presence of a downwardly depending lip 53 which extends across the module 50 in a downward direction (i.e. in a direction away from the service which is mounted to the presser foot bar 52) such that, in use, only this lip 53 engages with the yarns. As will be apparent from a comparison of FIGS. 2A and 2B, the presser surface 53A provided on the lower face of the lip 53 is significantly narrower than the presser surface 53B of the prior art and there is a wide region 53C behind the lip 53 where the yarns do not engage with the presser foot module.

As a third modification, the fingers 12 have been shortened. In particular, the ratio of the maximum length of a finger to the pitch of the fingers has been reduced from 4.3 to less than 4, more preferably less than 3.5 and most preferably less than 3. This saves material and reduces weight. Now that the bar is no longer required, the size of the opening between adjacent fingers is no longer an issue in the threading operation.

The lower edge of each finger 12 has a groove 14 which represents a region where the lower edge is spaced further from the backing medium 1. The finger therefore has a position of minimum height part way along its length and increases in height in both directions away from that position.

In use, the yarns extend down between adjacent fingers and the portions of the yarn which end up on the rear surface of the backing medium 1 then slide under the module body 13. The groove 14 allows the yarn to pass readily beneath the lower edge of the finger 12 and helps to keep it in place in a controlled position which is away from any stitch location of a subsequent stitch.

By providing the lip 53, rather than the yarn engaging surface across a wide portion of the module 13, the yarns only engage under the lip leading to a reduced frictional force between the presser foot and the yarn. Also, as the lip 53 represents a single line of contact between the presser foot and the yarn, it is easier to control the amount of pressure on the yarn. Control of this pressure is important and it requires a balance between creating a pressure which is high enough to ensure that the loose ends of yarn stay under the presser foot, but which is not high enough to generate undue friction on the yarns.

The invention claimed is:

1. A presser foot module for a tufting machine, the presser foot module having a module body for attachment to the tufting machine and a plurality of fingers with a pitch, the fingers extending from the module body in a first direction such that the fingers are spaced in a transverse direction transverse to the first direction, which, in use, is opposite to a direction in which backing medium is fed through the tufting machine;

wherein the module body has a downwardly depending lip defining a presser surface extending across an end of the module body, the presser surface is adjacent to an interface with the fingers, and wherein the downwardly depending lip extends downwardly to a greater extent than a surrounding portion of the module body, and the presser surface extends across the end of the module body in the transverse direction transversely beyond the plurality of fingers.

2. The presser foot module according to claim 1, wherein the dimension of the downwardly depending lip has a dimension in the first direction, which dimension is less than 1.5 times the pitch of the fingers.

3. The presser foot module according to claim 2, wherein the dimension of the downwardly depending lip in the first direction is less than the pitch of the fingers.

4. The presser foot module according to claim 1, wherein the dimension of the downwardly depending lip has a dimension in the first direction, wherein the dimension is greater than 0.5 times the pitch of the fingers.

5. The presser foot module according to claim 1, wherein each finger has a first end mounted in the module body and a second end opposite to the first end which is unsupported so as to provide access to an open gap between adjacent fingers in a second direction opposite to the first direction.

6. The presser foot module according to claim 5, wherein a ratio of a maximum length of a finger to the pitch of the fingers is less than 4.

7. The presser foot module according to claim 6, wherein the ratio of the maximum length of a finger to the pitch of the fingers is less than 3.5.

8. The presser foot module according to claim 7, wherein the ratio of the maximum length of a finger to the pitch of the fingers is less than 3.

9. The presser foot module according to claim 1, wherein a lower edge of each finger has a groove.

10. A presser foot bar comprising at least one presser foot module according to claim 1.

11. A tufting machine comprising:

a plurality of needles arranged on a first side of a plane along which, in use, a backing medium is fed through the machine in a first direction, the needles being reciprocable to penetrate the backing medium to form a loop of yarn on a second side of the plane;

a plurality of hooks or loopers arranged on the second side of the plane to receive respective loops of yarn formed by the needles;

at least one presser foot module arranged on the first side of the plane, the presser foot module having a module body with a first module side for attachment to the tufting machine and a plurality of fingers extending from the module body in a second direction which, in use, is opposite to the first direction in which the backing medium is fed through the tufting machine; wherein the module body has a downwardly depending lip defining a presser surface extending across an end of the module body which is adjacent to an interface with the fingers, the module having a second module side opposite to the first module side, the second module side being provided with the presser surface, wherein the fingers do not extend below the presser surface, and wherein each finger is a single planar component in a plane transverse to the presser surface.

12. A presser foot module for a tufting machine, the module having a module body with an upper face for attachment to a tufting machine and a plurality of fingers extending from the module body in a first direction which, in use, is opposite to a backing medium direction in which backing medium is fed through the tufting machine, each finger having a first end mounted in the module body and a second end opposite to the first end which is unsupported so as to provide access to an open gap between adjacent fingers in the backing medium direction opposite to the first direction, wherein the presser foot module has a lower face opposite to the upper face provided with a presser surface extending across the module body to engage, in use, with the backing medium fed through the tufting machine, wherein the fingers do not extend below the presser surface; wherein at least part of the lower edge of each finger is greater than 0.5 mm above the presser surface, and wherein each finger is formed as a single planar component, the planar component oriented in a plane transverse to the presser surface, wherein each finger of the presser foot module has a lower edge with a groove.

13. The presser foot module according to claim 12, wherein a ratio of a maximum length of a finger to a pitch of the fingers is less than 4.

14. The presser foot module according to claim 13, wherein the ratio of the maximum length of a finger to the pitch of the fingers is less than 3.5.

15. A presser foot bar comprising at least one presser foot module according to claim 12.

16. A tufting machine comprising:

a plurality of needles arranged on a first side of a plane along which, in use, a backing medium is fed through the tufting machine, the needles being reciprocable to penetrate the backing medium to form a loop of yarn on a second side of the plane;

a plurality of hooks or loopers arranged on a second side of the plane opposite to the first side to receive respective loops of yarn formed by the needles;

at least one presser foot module arranged on the first side of the plane, the module having a module body for attachment to the tufting machine and a plurality of fingers extending from the body in a first direction which, in use, is opposite to a backing medium direction in which the backing medium is fed through the tufting machine, each finger having a first end mounted in the module body and a second end opposite to the first end which is unsupported so as to provide access to an open gap between adjacent fingers in the backing medium direction opposite to the first direction; and wherein each finger is formed as a single planar component, the planar component oriented in a plane transverse to a presser surface of the modular body wherein the presser foot module has a lower face opposite to an upper face provided with a presser surface extending across the module body to engage, in use, with the backing medium fed through the tufting machine and wherein the fingers do not extend below the presser surface; wherein at least part of the lower edge of each finger is greater than 0.5 mm above the presser surface, wherein each finger of the presser foot module has a lower edge with a groove.

17. The presser foot module according to claim 14, wherein the ratio of the maximum length of a finger to the pitch of the fingers is less than 3.

* * * * *